US007766696B2

(12) United States Patent
Conner et al.

(10) Patent No.: US 7,766,696 B2
(45) Date of Patent: Aug. 3, 2010

(54) COAXIAL CABLE CONNECTOR ASSEMBLY

(75) Inventors: Troy Everette Conner, York, PA (US); Jacob Glenn Havener, Middletown, PA (US); Robert David Rix, Hershey, PA (US)

(73) Assignee: Tyco Electronics Corporation, Middletown, PA (US)

( * ) Notice: Subject to any disclaimer, the term of this patent is extended or adjusted under 35 U.S.C. 154(b) by 92 days.

(21) Appl. No.: 11/881,320

(22) Filed: Jul. 26, 2007

(65) Prior Publication Data

US 2009/0029589 A1 Jan. 29, 2009

(51) Int. Cl.
*H01R 9/05* (2006.01)

(52) U.S. Cl. ..... 439/581

(58) Field of Classification Search ..... 439/579, 439/581, 578, 63, 701, 541.5
See application file for complete search history.

(56) References Cited

U.S. PATENT DOCUMENTS

| | | | | |
|---|---|---|---|---|
| 4,842,543 | A * | 6/1989 | Davis | 439/378 |
| 5,718,606 | A * | 2/1998 | Rigby et al. | 439/608 |
| 6,045,402 | A * | 4/2000 | Embo et al. | 439/579 |
| 6,305,976 | B1 * | 10/2001 | Tsuji et al. | 439/570 |
| 6,358,062 | B1 * | 3/2002 | Feldman et al. | 439/63 |
| 6,409,550 | B1 * | 6/2002 | Splichal et al. | 439/701 |
| 6,468,089 | B1 * | 10/2002 | Hubbard et al. | 439/63 |
| 6,686,540 | B2 * | 2/2004 | Compagnone, Jr. | 174/58 |
| 6,746,277 | B2 | 6/2004 | Laub et al. | |
| 6,902,408 | B2 | 6/2005 | Yamane | |
| 7,086,866 | B1 * | 8/2006 | Folan et al. | 439/53 |
| 7,160,151 | B1 * | 1/2007 | Rigby et al. | 439/607 |
| 7,234,967 | B2 * | 6/2007 | Weidner et al. | 439/581 |
| 2004/0147149 | A1 * | 7/2004 | Wang | 439/145 |
| 2004/0235344 | A1 * | 11/2004 | Kleeberger et al. | 439/540.1 |
| 2004/0235377 | A1 * | 11/2004 | Byma et al. | 442/43 |
| 2006/0270254 | A1 * | 11/2006 | Chiang et al. | 439/137 |

* cited by examiner

*Primary Examiner*—Alexander Gilman

(57) ABSTRACT

An electrical connector assembly is provided for electrically connecting a plurality of coaxial cables to a circuit board. The assembly includes a housing having a mounting side portion configured to be mounted to the circuit board and a mating side portion opposite the mounting side portion. A plurality of coaxial cable connectors are held by the housing. Each coaxial cable connector includes an outer electrical contact and an inner electrical contact extending generally coaxially with each other. Each outer and inner electrical contact extends from a mating end portion on the mating side portion of the housing to a mounting end portion. The mounting end portion of each of the outer and inner electrical contacts is configured to be electrically connected to a corresponding electrical contact on the circuit board. The mating end portion of each of the outer and inner electrical contacts is configured to be electrically connected to an electrical contact of a corresponding one of the coaxial cables.

17 Claims, 12 Drawing Sheets

COAXIAL CABLE CONNECTOR ASSEMBLY

BACKGROUND OF THE INVENTION

The invention relates generally to coaxial cables, and, more particularly, to electrical connector assemblies for coaxial cables.

Due to their favorable electrical characteristics, coaxial cables and connectors have grown in popularity for interconnecting electronic devices and peripheral systems. Typically, coaxial cable connectors are mounted to a circuit board of an electronic device at an input/output port of the device and extend through an exterior housing of the device for connection with a mating connector, typically in the form of a cable and plug assembly. The coaxial cable connectors include an inner conductor coaxially disposed within an outer conductor, with a dielectric material separating the inner and outer conductors.

Typically, each coaxial cable connector on the circuit board is installed on the board separately. Moreover, each coaxial cable is often separately mated to, and unmated from, the corresponding coaxial cable connector. However, as the number of interconnects on the circuit board increase, so does the number of coaxial cable connectors that need to be installed on the board and mated with a corresponding coaxial cable. At least some known coaxial cable connectors may therefore be difficult and/or time consuming to install and/or to mate and unmate with the corresponding coaxial cables. Separately mating and unmating each of the coaxial cable connectors with the corresponding coaxial cable may also be difficult because of a relatively small size of some known coaxial cable connectors. For example, it may be difficult to mate and unmate the coaxial cable connectors with the corresponding coaxial cable by hand. Often, a specialized tool must be used to mate and/or unmate a coaxial cable with the corresponding coaxial cable connector.

There is a need for a coaxial cable connector that is more easily installed on a circuit board or other portion of an electronic device. There is also a need for a coaxial cable connector that is more easily mated and unmated with a coaxial cable.

BRIEF DESCRIPTION OF THE INVENTION

In one embodiment, an electrical connector assembly is provided for electrically connecting a plurality of coaxial cables to a circuit board. The assembly includes a housing having a mounting side portion configured to be mounted to the circuit board and a mating side portion opposite the mounting side portion. A plurality of coaxial cable connectors are held by the housing. Each coaxial cable connector includes an outer electrical contact and an inner electrical contact extending generally coaxially with each other. Each outer and inner electrical contact extends from a mating end portion on the mating side portion of the housing to a mounting end portion. The mounting end portion of each of the outer and inner electrical contacts is configured to be electrically connected to a corresponding electrical contact on the circuit board. The mating end portion of each of the outer and inner electrical contacts is configured to be electrically connected to an electrical contact of a corresponding one of the coaxial cables.

In another embodiment, an electrical connector assembly is provided for electrically connecting a plurality of coaxial cables to a circuit board. The assembly includes a connector housing having a mounting side portion configured to be mounted to the circuit board and a mating side portion opposite the mounting side portion. A plurality of first coaxial cable connectors are held by the connector housing. Each first coaxial cable connector includes a first outer electrical contact and a first inner electrical contact extending generally coaxially with each other. Each first outer and inner electrical contact extends from a mating end portion on the mating side portion of the housing to a mounting end portion. The mounting end portion of each of the first outer and inner electrical contacts is configured to be electrically connected to at least one corresponding electrical contact on the circuit board. The assembly further includes a coaxial cable housing having opposite first and second side portions. A plurality of second coaxial cable connectors are held by the coaxial cable housing. Each of the second coaxial cable connectors define an end portion of a corresponding one of the coaxial cables and include a second outer electrical contact and a second inner electrical contact extending generally coaxially with each other. The mating end portion of each of the first outer electrical contacts is configured to electrically connect to the second outer electrical contact of a corresponding one of the coaxial cables. The mating end portion of each of the first inner electrical contacts is configured to electrically connect to the second inner electrical contact of a corresponding one of the coaxial cables.

In another embodiment, an electrical connector assembly is provided for electrically interconnecting a plurality of coaxial cables. The assembly includes a housing having a first mating side portion and a second mating side portion. A plurality of first coaxial cable connectors are held by the connector housing at least partially on the first mating side portion of the housing. Each first coaxial cable connector includes a first outer electrical contact and a first inner electrical contact extending generally coaxially with each other. A plurality of second coaxial cable connectors are held by the connector housing at least partially on the second mating side portion of the housing. Each second coaxial cable connector includes a second outer electrical contact and a second inner electrical contact extending generally coaxially with each other. The second outer electrical contact of each of the second coaxial cable connectors is electrically connected to the first outer electrical contact of a corresponding one of the first coaxial cable connectors. The second inner electrical contact of each of the second coaxial cable connectors is electrically connected to the first inner electrical contact of a corresponding one of the first coaxial cable connectors.

DETAILED DESCRIPTION OF THE INVENTION

Figure 1:
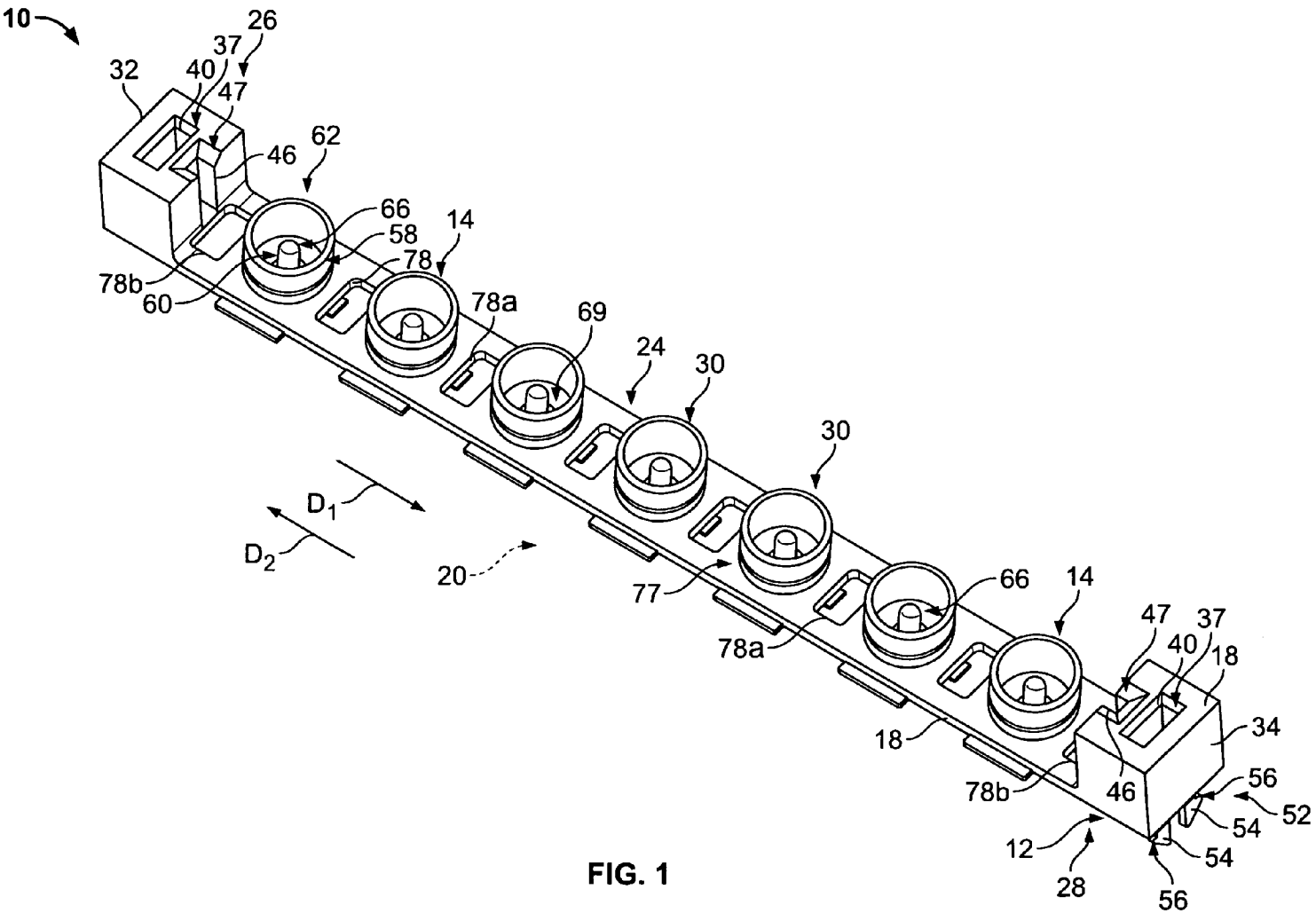
FIG. 1 is a perspective view of an exemplary embodiment of an electrical connector assembly.
Figure 2:
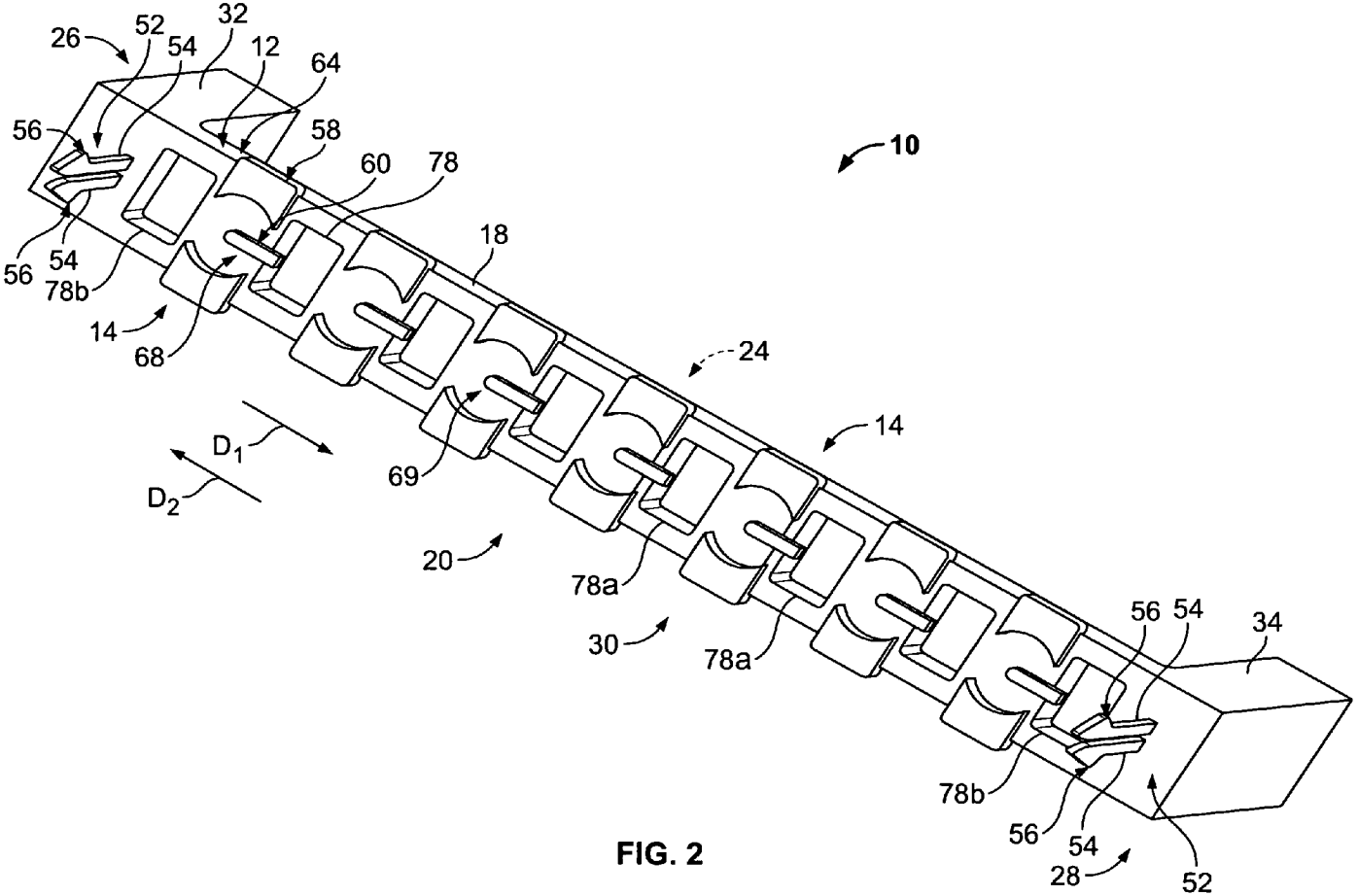
FIG. 2 is another perspective view of the assembly shown in FIG. 1.

FIGS. 1 and 2 are perspective views of an exemplary embodiment of an electrical connector assembly 10. The assembly 10 includes a housing 12 that holds a plurality of electrical connectors 14. The electrical connectors 14 are each configured to electrically connect to a coaxial cable 16 (FIGS. 6, 8, 9, 10, and 13), and will be referred to herein as coaxial cable connectors 14. The housing 12 includes a body 18 having a mounting side portion 20 that is configured to be mounted on a circuit board 22 (FIGS. 5, 6, 8, and 10), as will be described in more detail below. The housing body 18 may be dielectric, may be electrically conductive, or a portion of the housing body 18 may be dielectric and another portion may be electrically conductive. The housing body 18 also includes a mating side portion 24 that is opposite the mounting side portion 20. A portion of each of the coaxial cable connectors 14 extends along the mating side portion 24 of the housing body 18 for electrically connecting the coaxial cables 16 to the circuit board 22. Although not shown herein, the housing 12 may optionally be configured to be mounted, or received, within an opening (not shown) of a panel (not shown) that is adjacent the circuit board 22. For example, the panel may be a wall of a housing of a device (not shown), such as, but not limited to, a computer, that includes the circuit board 22. In such an example, the electrical connector assembly 10 enables coaxial cables 16 located outside the device housing to be electrically connected to the circuit board 22 contained within the device housing.

Figure 3:
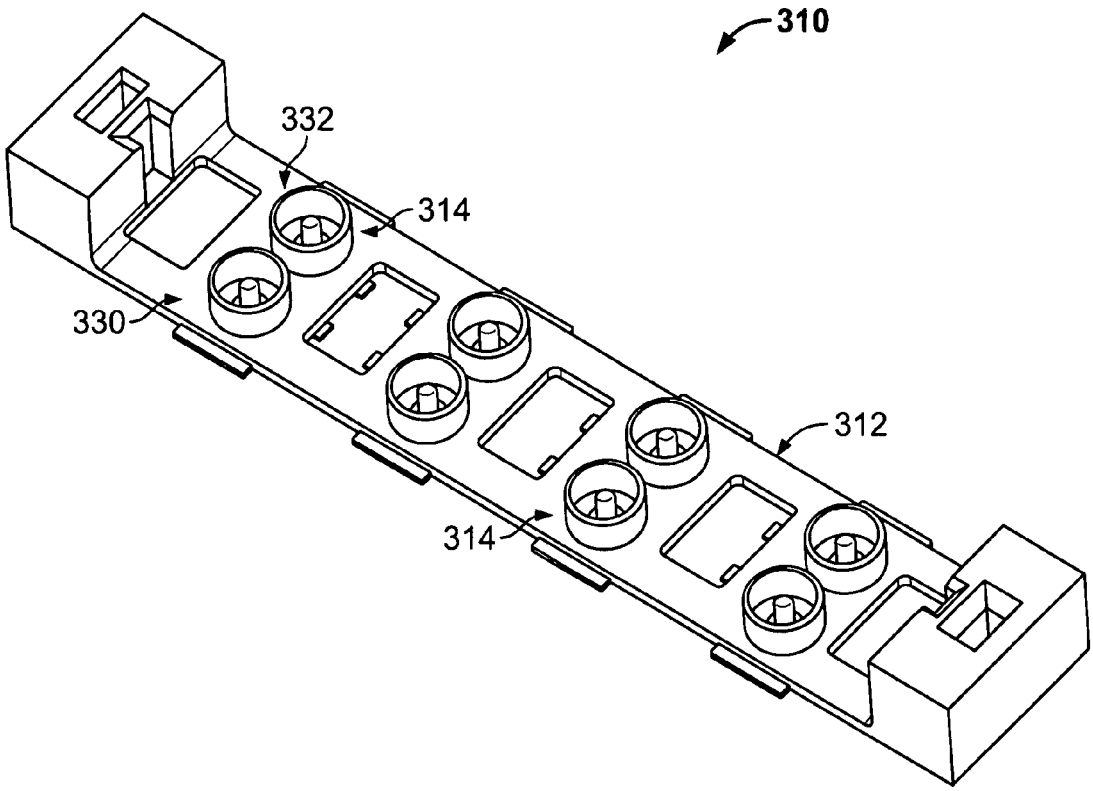
FIG. 3 is a perspective view of an alternative embodiment of an electrical connector assembly.
Figure 4:
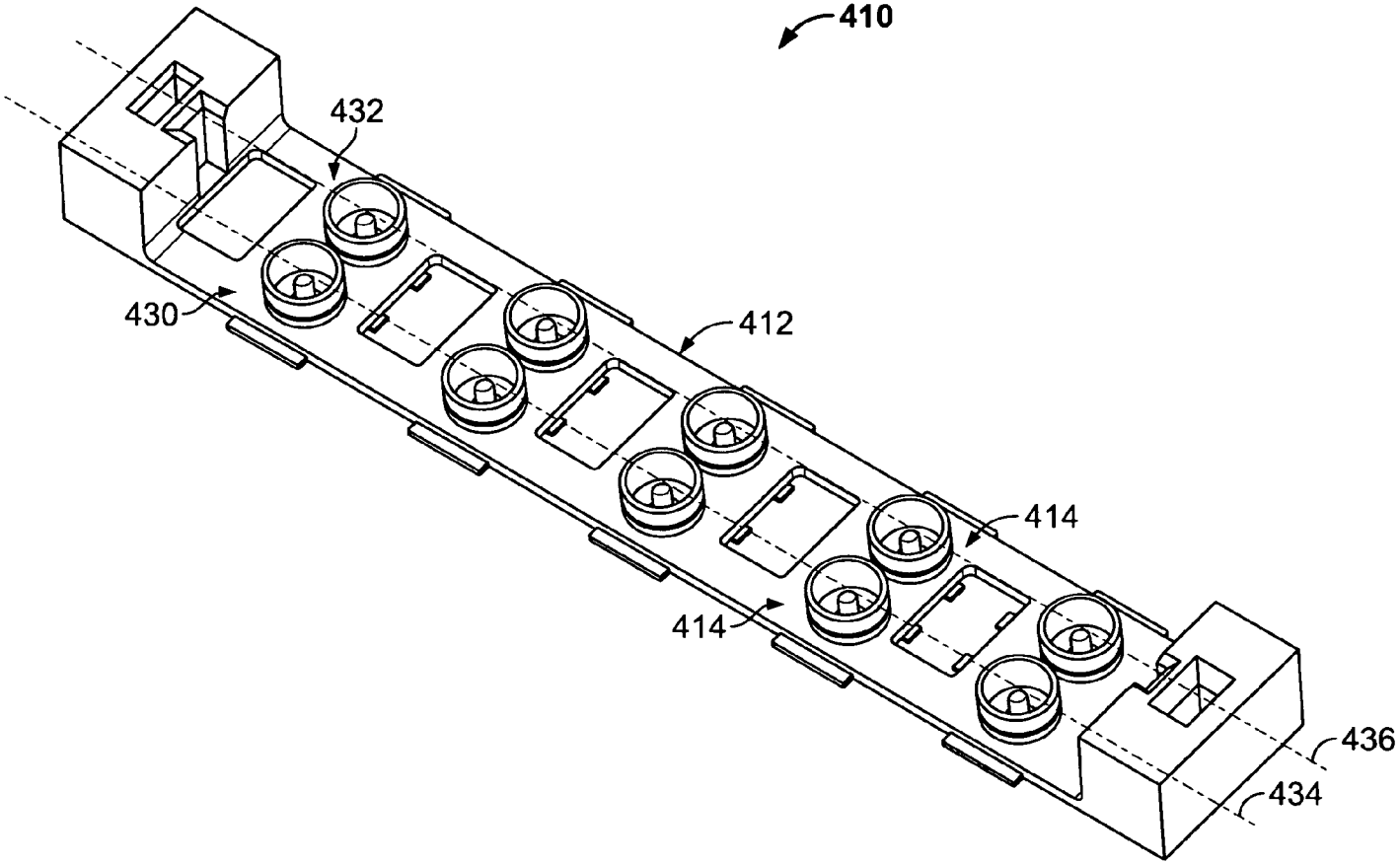
FIG. 4 is a perspective view of another alternative embodiment of an electrical connector assembly.

The housing body 18 extends between a pair of opposite end portions 26 and 28. In the exemplary embodiment of FIGS. 1 and 2, the housing body 18 is elongate and holds the coaxial cable connectors 14 in a single row 30 that extends between the opposite end portions 26 and 28. However, the housing body 18 may hold the coaxial cable connectors 14 in any arrangement, pattern, and/or the like that enables the coaxial cables 16 to be electrically connected to the circuit board 22. Moreover, although seven coaxial cable connectors 14 are shown in FIGS. 1 and 2, the housing body 18 may hold any number of coaxial cable connectors 14 for electrically connecting any number of coaxial cables 16 to the circuit board 22. By way of example, FIG. 3 illustrates an exemplary alternative embodiment of an electrical connector assembly 310 that includes a housing 312 having two rows 330 and 332 of coaxial cable connectors 314. FIG. 4 illustrates another exemplary alternative embodiment of an electrical connector assembly 410 that includes a housing 412 having two rows 430 and 432 of coaxial cable connectors 414. The coaxial cable connectors 414 are staggered within each row 430 and 432 on opposite sides of a longitudinal axis 434 and 436 of the respective row 430 and 432. Embodiments of the coaxial cable connectors are not limited to the patterns, arrangements, and/or the like described and/or illustrated herein. Rather, embodiments of the coaxial cable connectors may be held by the housing in any suitable pattern, arrangement, and/or the like that enables the electrical connector assembly embodiments to function as described and/or illustrated herein.

Referring again to FIGS. 1 and 2, the housing body 18 includes a pair of opposite support members 32 and 34 extending on the mating side portion 24 at each of the end portions 26 and 28, respectively. The support members 32 and 34 facilitate supporting a cover 36 (FIGS. 7 and 8) or a coaxial cable housing 38 (FIGS. 9 and 10) that may optionally be used with the electrical connector assembly embodiments described and/or illustrated herein, as will be described in more detail below. Optionally, the support members 32 and/or 34 may each include a latch opening 40 for cooperating with a latch projection 42 (FIG. 7) of the cover 36 and/or a latch projection 44 (FIG. 9) of the coaxial cable housing 38 to latch the cover 36 and/or the coaxial cable housing 38 to the housing 12, as will also be described in more detail below. The latch openings 40 may optionally include a beveled edge portion 37 to facilitate receiving the latch projections 42 and/or 44 therein. In addition or alternative to the latch opening 40, the support members 32 and/or 34 may each include a latch projection (not shown) for cooperating with a latch opening (not shown) of the cover 36 and/or the housing 38. Additionally or alternatively, the housing body 18 may include latch projections and/or latch openings at other locations of the housing 12 than the support members 32 and/or 34. Although two latch openings 40 are shown, the housing 12 may include any number of latch openings 40. Moreover, although shown as generally rectangular, the latch openings 40 may have any suitable shape that enables the latch openings 40 to function as described and/or illustrated herein.

The support members 32 and/or 34 may optionally each include an alignment opening 46 for cooperating with an alignment projection 48 (FIG. 7) of the cover 36 and/or an alignment projection 50 (FIG. 9) of the coaxial cable housing 38 to facilitate aligning the cover 36 and/or the coaxial cable housing 38 with the housing 12, as will be described in more detail below. The alignment openings 46 may optionally include a beveled edge portion 47 to facilitate receiving the alignment projections 48 and 50 therein. In addition or alternative to the alignment opening 46, the support members 32 and/or 34 may each include an alignment projection (not shown) for cooperating with an alignment opening (not shown) of the cover 36 and/or the housing 38. Additionally or alternatively, the housing body 18 may include alignment projections and/or alignment openings at other locations of the housing body 18 than the support members 32 and/or 34. Although two alignment openings 46 are shown, the housing 12 may include any number of alignment openings 46. Moreover, although shown as generally rectangular, the alignment openings 46 may have any suitable shape that enables the alignment openings 46 to function as described and/or illustrated herein.

The housing body 18 includes a pair of latch projections 52 extending outwardly on the mounting side portion 20 to latch the housing body 18 to the circuit board 22. Although the latch projections 52 may include any suitable structure, means, configuration, arrangement, and/or the like, in the exemplary embodiment the latch projections 52 each include a pair of deflectable members 54. Each of the deflectable members 54 includes a hook portion 56 that is configured to engage the circuit board 22 to latch the housing body 18 to the circuit board 22, as will be described in more detail below. Although two latch projections 52 are shown, the housing 12 may include any number of latch projections 52.

Each of the coaxial cable connectors 14 includes an outer electrical contact 58 and an inner electrical contact 60 extending generally coaxially with each other. The outer electrical contacts 58 each extend from a mating end portion 62 on the mating side portion 24 of the housing body 18 to a mounting end portion 64 on the mounting side portion 20 of the housing body 18. Similarly, the inner electrical contacts 60 each extend from a mating end portion 66 on the mating side portion 24 of the housing body 18 to a mounting end portion 68 on the mounting side portion 20 of the housing body 18. In the exemplary embodiment, the housing body 18 is dielectric and for each coaxial cable connector 14, a corresponding portion 69 of the housing body 18 separates the outer and inner electrical contacts 58 and 60, respectively, from one another to electrically isolate the outer and inner electrical contacts 58 and 60, respectively, from one another. Alternatively, whether or not the housing body 18 is at least partially dielectric, one or more dielectric members (not shown) that is separate from the housing body 18 (but which may be attached to the housing body 18) may separate the outer and inner electrical contacts 58 and 60, respectively, from one another to electrically isolate the outer and inner electrical contacts 58 and 60, respectively, from one another. If included, the dielectric member(s) that is separate from the housing body 18 may be fabricated from the same and/or different materials of any dielectric portions that the housing body 18 may include.

As will be described in more detail below, the mounting end portion 64 and 68 of each of the outer and inner electrical contacts 58 and 60, respectively, is configured to be electrically connected to a corresponding electrical contact 70 and 72 (FIG. 5), respectively, on the circuit board 22. Similarly, the mating end portion 62 and 66 of each of the outer and inner electrical contacts 58 and 60, respectively, is configured to be electrically connected to an outer and inner electrical contact 88 and 86 (FIG. 9), respectively, of a corresponding one of the coaxial cables 16.

In the exemplary embodiment, a radial gap between the outer and inner electrical contacts 88 and 86, respectively, of each of the coaxial cables 16 defines a receptacle 75 (FIG. 9) that is configured to receive a plug portion 77 of the corresponding coaxial cable connector 14 therein, as will be described in more detail below. Alternatively, one or more of the coaxial cable connectors 14 may define a receptacle (not shown) for receiving a plug portion (not shown) of the corresponding coaxial cable 16. In the exemplary embodiment, the outer electrical contacts 58 are ground contacts and the inner electrical contacts 60 are signal contacts. However, one or more of the outer electrical contacts 58 may alternatively be a signal contact and/or one or more of the inner electrical contacts 60 may alternatively be a ground contact. Although shown as having a generally circular cross-sectional shape, the coaxial cable connectors 14 may alternatively have any other suitable cross-sectional shape that enables the connectors 14 to function as described and/or illustrated herein, such as, but not limited to, a rectangular cross-sectional shape.

Optionally, the housing body 18 includes one or more openings 78 therein that extend through the housing body 18 adjacent one or more of the coaxial cable connectors 14. In the exemplary embodiment, the housing body 18 includes a plurality of openings 78. Each opening 78 of an interior group **78*a* of the openings 78 extends between two adjacent coaxial cable connectors 14 within the row 30 thereof. Each opening 78 of an exterior group 78*b* of the openings 78 extends between an adjacent coaxial cable connector 14 and the corresponding support member 32 and 34. Each of the openings 78 exposes at least a portion of the mounting end portion 68 of the inner electrical contact 60 of one of the adjacent coaxial cable connectors. As described below, when the housing body 18 is mounted on the circuit board 22, the openings 78 expose at least a portion of an interface 79 (FIG. 5) between the mounting end portion 68 of the inner electrical contact 60 and the corresponding electrical contact 72 of the circuit board 22. In the exemplary embodiment, the mounting end portions 68 of each of the inner electrical contacts 60 extend in generally the same common direction $D_1$. Accordingly, each opening 78 exposes only one of the mounting end portions 68. Alternatively, some of the mounting end portions 68 may face in a generally opposite direction $D_2$ such that one or more of the openings 78 may expose both of the mounting end portions 68 of two adjacent coaxial cable connectors 14**.

Embodiments of the openings 78 within the housing body 18 are not limited to the sizes, shapes, patterns, arrangements, and/or the like described and/or illustrated herein. Rather, embodiments of the openings 78 may have any suitable pattern, arrangement, and/or the like, and/or each opening 78 may have any suitable size and/or shape, that enables the openings 78 to expose at least a portion of the interface 79 between the mounting end portion 68 of the inner electrical contact 60 and the corresponding electrical contact 72 of the circuit board 22. In some alternative embodiments, the size, shape, pattern, arrangement, and/or the like of the openings 78 (and/or of the coaxial cable connectors 14 and/or of the mounting end portions 68 of the inner electrical contacts 60) may be selected to expose the interface between more than two mounting end portions 68 of the inner electrical contacts 60 and the corresponding electrical contacts of the circuit board 22. Further, in addition or alternative to the embodiment shown in FIGS. 1 and 2, the size, shape, pattern, arrangement, and/or the like of the openings 78 (and/or of the coaxial cable connectors 14 and/or of the mounting end portions 64 of the outer electrical contacts 58) may be selected to expose the interface between one or more mounting end portions 64 of the outer electrical contacts 58 and the corresponding electrical contacts of the circuit board 22. Although eight openings 78 are shown in FIGS. 1 and 2, the housing body 18 may include any number of openings 78 for exposing any number of mounting end portions 64 and/or 68.

Although the housing body 18 is described herein in the exemplary embodiment as being dielectric, the housing body 18 may additionally or alternatively be fabricated from at least partially from an electrically conductive material such that the housing body 18 forms a common ground for each of the coaxial cable connectors 14 that are held thereby. In such an embodiment, the portions 69 of the housing body 18 may remain dielectric to electrically isolate the inner electrical contacts 60 from the outer electrical contacts 58 and the common ground formed by the housing body 18, or as described above a dielectric member (not shown) that is separate from the housing body 18 (but which may be attached to the housing body 18), may electrically isolate the outer and inner electrical contacts 58 and 60, respectively, from one another. Further, the mounting end portions 68 of the inner electrical contacts 60 are electrically isolated from the electrically conductive portions of the housing body 18 in embodiments wherein the housing body 18 forms a common ground.

Figure 5:
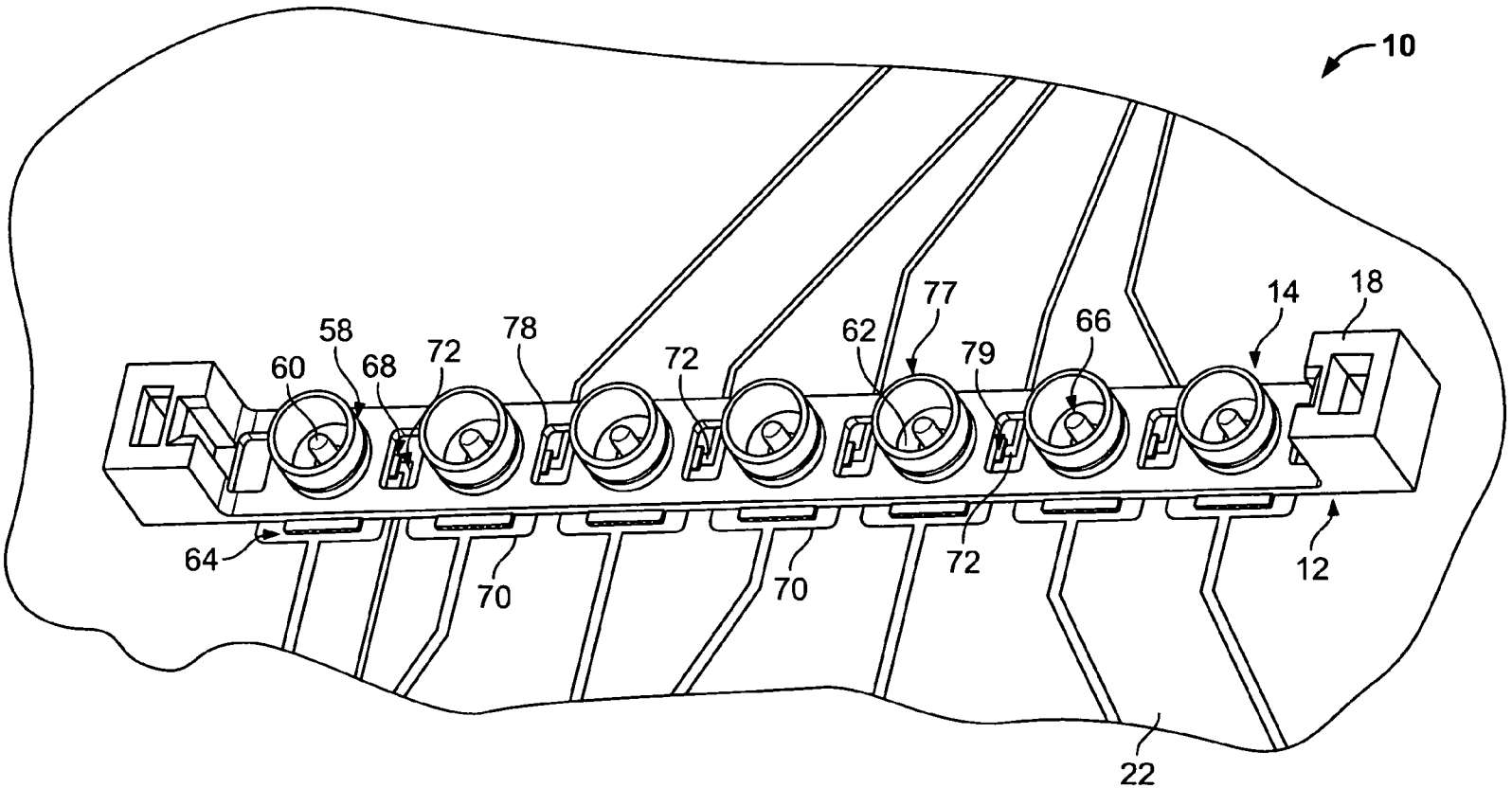
FIG. 5 is a perspective view of the electrical connector assembly shown in FIGS. 1 and 2 mounted on a circuit board.

FIG. 5 is a perspective view of the electrical connector assembly 10 mounted on the circuit board 22. Each of the latch projections 52 (FIGS. 1 and 2) is received within a corresponding latch opening (not shown) within the circuit board 22. As the latch projections 52 are received within the latch openings of the circuit board 22, the deflectable members 54 (FIGS. 1 and 2) are deflected inwardly toward each other until the hook portions 56 (FIGS. 1 and 2) clear a shoulder (not shown) of the circuit board 22. Once the hook portions 56 clear the shoulder, the deflectable members 54 move outwardly away from each other and the hook portions 56 engage the shoulder to latch the electrical connector assembly 10 to the circuit board 22. The latch openings of the circuit board 22 may optionally include a beveled edge portion (not shown) to facilitate receiving the latch projections 52 therein.

When the assembly 10 is mounted on the circuit board, the mounting end portion 64 of each of the outer electrical contacts 58 is electrically connected to the corresponding electrical contact 70 of the circuit board 22. Similarly, the mounting end portion 68 of each of the inner electrical contacts 60 is electrically connected to the corresponding electrical contact 72 of the circuit board 22. The electrical contacts 58 and 60 may be held in electrical connection with the respective contacts 70 and 72 using any suitable structure, means, configuration, arrangement, and/or the like that enables the electrical connector assembly 10 to function as described and/or illustrated herein, such as, but not limited to, using solder, solder balls, press-fit complaints contacts, non-compliant press-fit contacts, compression mounting, an elastomeric interface(s), electrically conductive epoxy, electrically conductive adhesive, wirebonding, and/or welding. Additionally or alternatively, in some embodiments the electrical contacts 58 and 60 are held in electrical connection with the respective contacts 70 and 72 by a latching force provided by the latching projections 52 and the circuit board 22. The suitable structure, means, configuration, arrangement, and/or the like that holds the electrical contacts 58 and 60 in electrical connection with the respective contacts 70 and 72 may also facilitate holding the assembly 10 on the circuit board 22. As used herein, "compressive mounting" refers to holding the electrical contacts 58 and 60 in electrical connection with the respective contacts 70 and 72 by applying a force to the electrical contacts 58 and/or 60 such that a non-permanent joint is formed between the electrical contacts 58 and 60 and the respective contacts 70 and 72.

As discussed above, the openings 78 expose at least a portion of the interface 79 between the mounting end portion 68 of the inner electrical contact 60 and the corresponding electrical contact 72 of the circuit board 22. The openings 78 enable verification of a quality of the electrical connection (e.g., a quality of the solder connection) between the inner electrical contact 60 and the corresponding electrical contact 72 of the circuit board 22 after the assembly 10 has been mounted on the circuit board 22.

Figure 6:
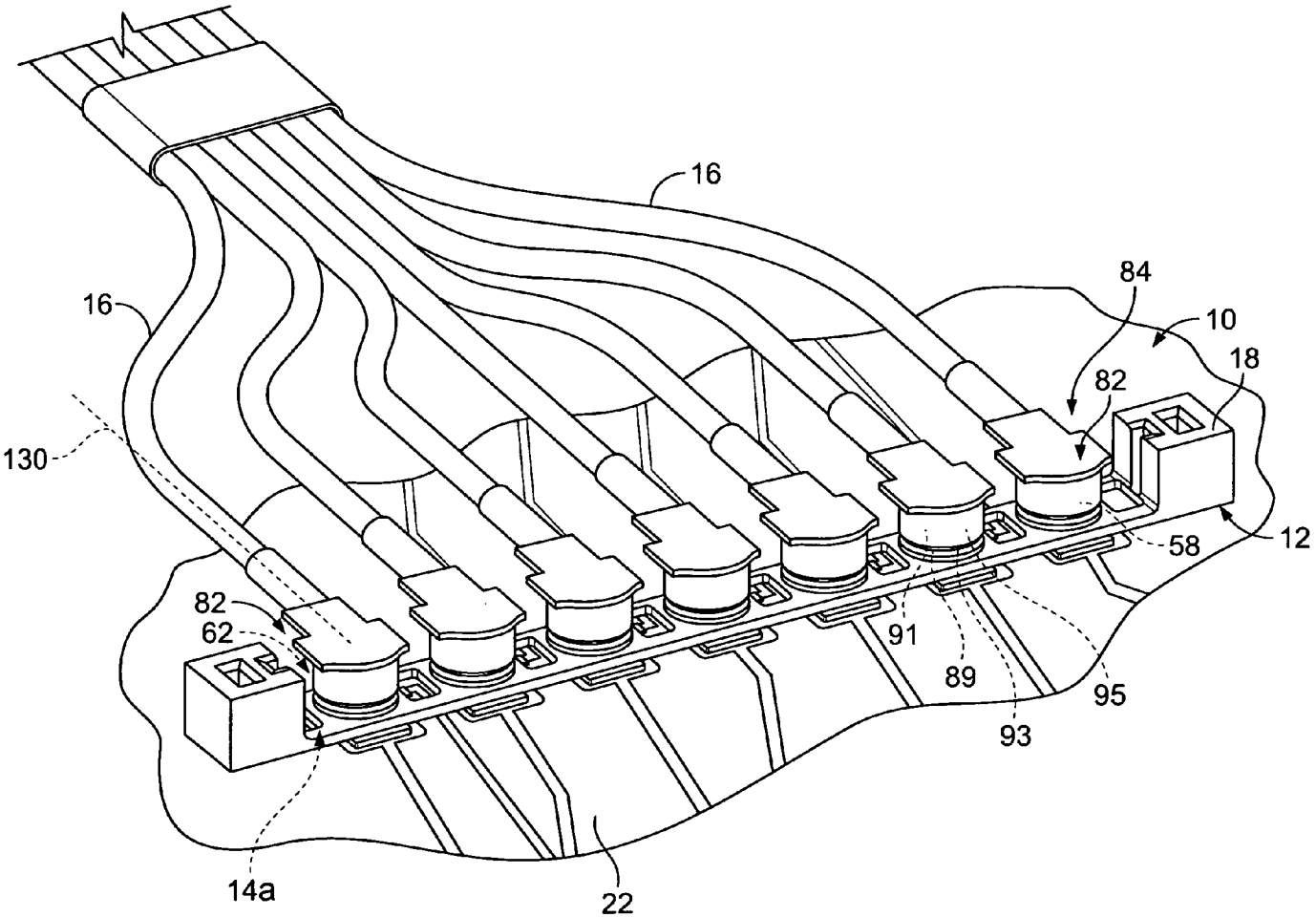
FIG. 6 is a perspective view of an exemplary embodiment wherein a plurality of coaxial cables are each separately mated with the electrical connector assembly shown in FIGS. 1, 2, and 5.

FIG. 6 is a perspective view of an exemplary embodiment of the electrical connector assembly 10 with the plurality of the coaxial cables 16 mated therewith. In the embodiment shown in FIG. 6, each of the coaxial cables 16 is separately mated with the electrical connector assembly 10. Specifically, each of the coaxial cables 16 includes a coaxial cable connector 82 that defines an end portion 84 of the cable 16. In the exemplary embodiment, the end portion 84 includes the receptacle 75 (FIG. 9), which receives the plug portion 77 (FIGS. 1 and 5) of the corresponding coaxial cable connector 14*a* when the coaxial cables 16 are mated with the electrical connector assembly as shown in FIG. 6. Each of the coaxial cable connectors 82 includes the inner electrical contact 86 (FIG. 9) and the outer electrical contact 88 (FIG. 9) extending generally coaxially with each other. When the coaxial cables 16 are mated with the assembly 10 as shown in FIG. 6, the mating end portion 62 of each of the outer electrical contacts 58 of the coaxial cable connectors 14*a* is electrically connected to the outer electrical contact 88 of the corresponding coaxial cable 16. Similarly, the mating end portion 66 (FIGS. 1 and 5) of each of the inner electrical contacts 60 (FIGS. 1, 2, and 5) of the coaxial cable connectors 14*a* is electrically connected to the inner electrical contact 86 of the corresponding coaxial cable 16.

In the exemplary embodiment of FIG. 6, each of the outer electrical contacts 58 of the connectors 14*a* includes a groove 89 (which can also be seen in FIGS. 1 and 5) extending within a radially outer surface 91 of the outer electrical contact 58 that cooperates with an extension 93 on a radially inner surface 95 of the outer electrical contact 88 of the corresponding coaxial cable connector 82. Cooperation between the groove 89 and the extension 93 creates a snap-fit connection that may facilitate holding the coaxial cables 16 on the assembly 10 and in electrical connection with the corresponding coaxial cable connector 14*a*. Additionally or alternatively, one or more of the outer electrical contacts 58 of the connectors 14*a* includes an extension (not shown) that cooperates with a groove (not shown) on the radially inner surface 95 of the outer electrical contact 88 of the corresponding coaxial cable connector 82.

Figure 7:
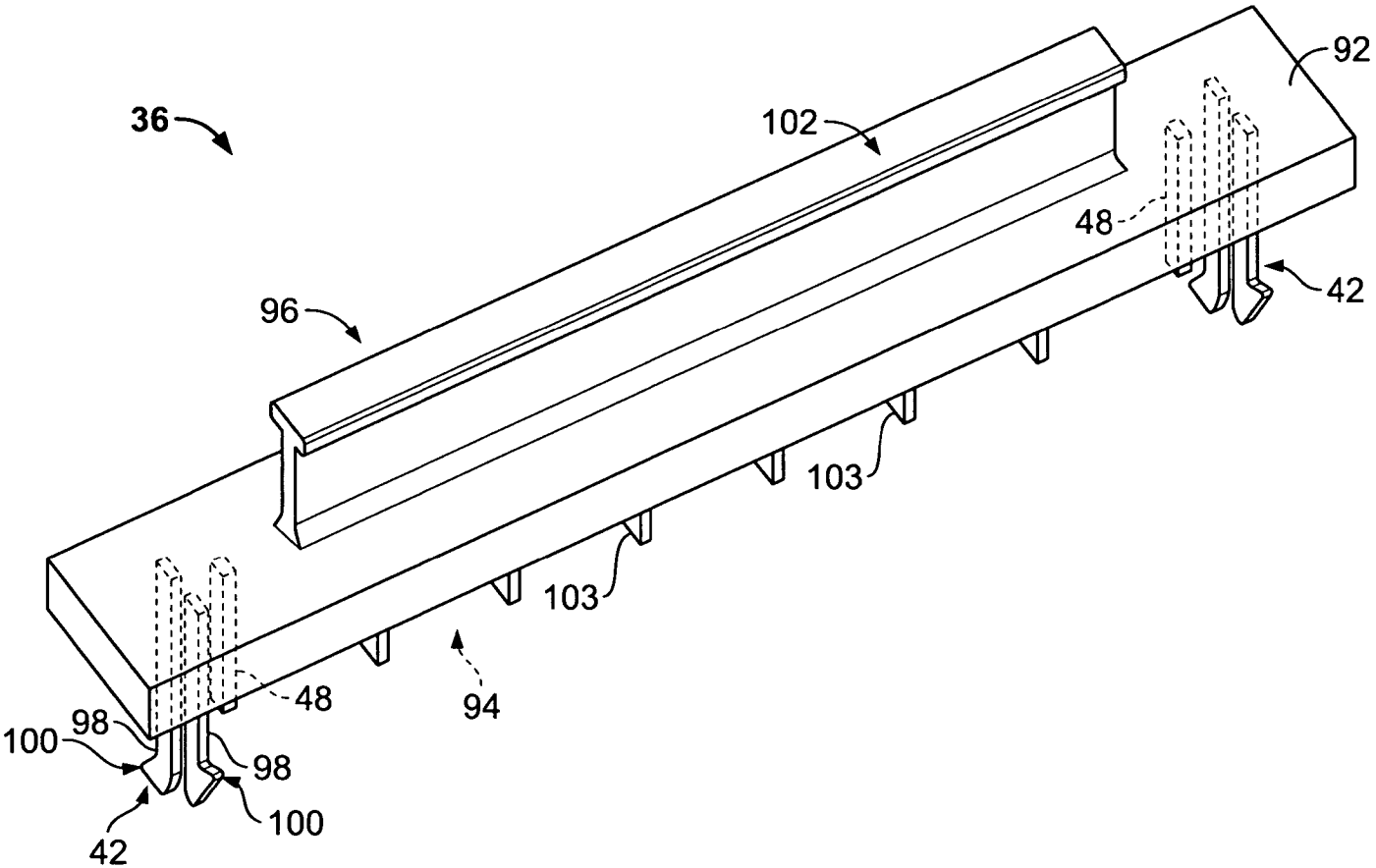
FIG. 7 is a perspective view of an exemplary embodiment of a cover that may be used with the electrical connector assembly embodiments described and/or illustrated herein.

FIG. 7 is a perspective view of an exemplary embodiment of the cover 36 that may be used with embodiments wherein each of the coaxial cables 16 (FIGS. 6, 8, 9, 10, and 13) is separately mated with the electrical connector assembly embodiments described and/or illustrated herein. The cover 36 includes a body 92 that covers at least a portion of the coaxial cable connectors 82 (FIGS. 6, 9, and 13) that define the end portions 84 (FIGS. 6 and 9) of each of the coaxial cables 16. The cover body 92 includes a mating side portion 94 and an opposite side portion 96, The cover body 92 may optionally include one or more of the alignment projections 48 described above with respect to FIGS. 1 and 2. Each alignment projection 48 cooperates with the alignment opening 46 (FIG. 1) within the corresponding support member 32 and/or 34 (FIGS. 1 and 2) to facilitate aligning the cover body 92 with the housing 12 (FIGS. 1, 2, 5, 6, 8, and 10) of the electrical connector assembly 10 (FIGS. 1, 2, 5, 6, 8, and 10). Although two alignment projections 48 are shown, the cover body 92 may include any number of alignment projections 48 for reception within any number of alignment openings 46. Moreover, although the alignment projections 48 are shown as generally rectangular, the alignment projections 48 may have any suitable shape that enables the alignment projections 48 to function as described and/or illustrated herein.

In the exemplary embodiment of FIG. 7, the cover body 92 is elongate and covers the single row 30 (FIGS. 1 and 2) of the seven coaxial cable connectors 82. However, the cover body 92 may cover any number, arrangement, pattern, and/or the like of the coaxial cable connectors 82. The cover body 92 may be mounted on the housing 12 of the electrical connector assembly 10 using any suitable suitable structure, means, configuration, arrangement, and/or the like that enables the cover 36 to function as described and/or illustrated herein, such as, but not limited to, using an adhesive. In the exemplary embodiment, the cover 36 includes one or more of the latch projections 42 described above with respect to FIGS. 1 and 2 for mounting the cover 36 on the assembly 10. Each latch projection 42 cooperates with the latch opening 40 (FIG. 1) within the corresponding support member 32 and/or 34 to latch the cover body 92 to the housing 12 of the electrical connector assembly 10. Although the latch projections 42 may include any suitable structure, means, configuration, arrangement, and/or the like, in the exemplary embodiment the latch projections 42 each include a pair of deflectable members 98. Each of the deflectable members 98 includes a hook portion 100 that engages a shoulder (not shown) of the housing body 18 (FIGS. 1, 2, 5, 6, 8, and 10) of the electrical connector assembly 10 to removably latch the cover 36 to the housing body 18. Although two latch projections 42 are shown, the cover body 92 may include any number of latch projections 42 for reception within any number of latch openings 40.

Optionally, the cover body 92 may include a handle 102. The handle 102 may have any suitable size, shape, and/or location on the cover body 92 that enables the handle 102 to function as described and/or illustrated herein. In the exemplary embodiment, the handle 102 includes a T-shaped cross-section and extends outwardly on the side portion 96. The handle 102 provides a structure for a user or machine (not shown) to grasp, and/or apply force to, when mating and unmating the cover 36 to the electrical connector assembly 10. Moreover, the handle 102 may provide a structure for a user or machine to grasp, and/or apply force to, to mount the electrical connector assembly 10 to the circuit board 22 (FIGS. 5, 6, 8, and 10). Specifically, the coaxial cables 16 and the cover 36 can be mounted on the electrical connector assembly 10 before the assembly 10 is mounted on the circuit board 22. The handle 102 can then be grasped by the user or the machine to place the electrical connector assembly 10, the coaxial cables 16, and the cover 36 at the desired location on the circuit board 22.

The cover body 92 may optionally include one or more extensions 103 extending outwardly along the mating side portion 94 of the cover body 92. As will be described below, the extensions 103 are configured to extend at least partially between two adjacent coaxial cable connectors 82 and at least partially between two adjacent coaxial cable connectors 14. Although six extensions 103 are shown, the cover body 92 may include any number of extensions 103. Moreover, although the extensions 103 are shown as generally rectangular, the extensions 103 may have any suitable shape that enables the extensions 103 to function as described and/or illustrated herein.

Figure 8:
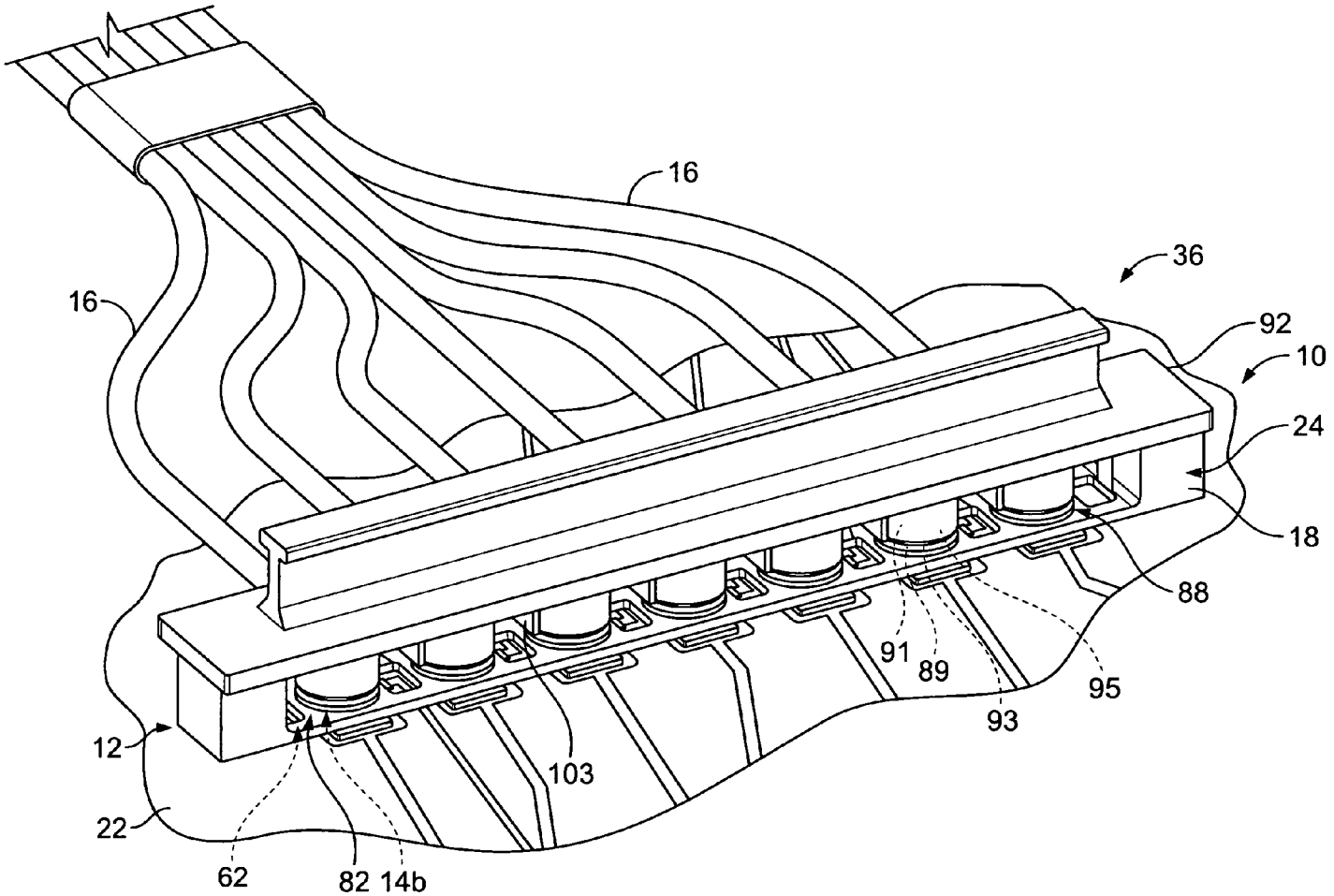
FIG. 8 is a perspective view of an exemplary embodiment illustrating both a plurality of coaxial cables and the cover shown in FIG. 7 mounted on the electrical connector assembly shown in FIGS. 1, 2, and 5.

FIG. 8 is a perspective view of an exemplary embodiment of the electrical connector assembly 10 illustrating the plurality of the coaxial cables 16 mated to the assembly 10 and the cover 36 mounted on the assembly 10. In the embodiment shown in FIG. 8, each of the coaxial cables 16 is separately mated with the electrical connector assembly 10. Specifically, the plug portion 77 (FIGS. 1 and 5) of each of the coaxial cable connectors 14*b* is received within the receptacle 75 (FIG. 9) of the corresponding coaxial cable connector 82 of the coaxial cables 16. The mating end portion 62 (FIGS. 1 and 5) of each of the outer electrical contacts 58 (FIGS. 1, 2, and 5) of the coaxial cable connectors 14*b* is electrically connected to the outer electrical contact 88 of the corresponding coaxial cable 16. Similarly, the mating end portion 66 (FIGS. 1 and 5) of each of the inner electrical contacts 60 (FIGS. 1, 2, and 5) of the coaxial cable connectors 14*b* is electrically connected to the inner electrical contact 86 (FIG. 9) of the corresponding coaxial cable 16.

Optionally, the radially outer surface 91 of each of the outer electrical contacts 58 of the connectors 14*b* may include the groove 89 and the radially inner surface 95 of the outer electrical contact 88 of the corresponding coaxial cable connector 82 may include the extension 93 described above with respect to FIG. 6. Cooperation between the extension 93 and the groove 89 creates a snap-fit connection that may facilitate holding the coaxial cables 16 on the assembly 10 and in electrical connection with the corresponding coaxial cable connector 14*b*. Additionally or alternatively, one or more of the outer electrical contacts 58 of the connectors 14*b* each includes an extension (not shown) that cooperates with a groove (not shown) on the radially inner surface 95 of the outer electrical contact 88 of the corresponding coaxial cable connector 82.

The cover 36 is mounted on the housing 12 of the assembly 10 such that the cover body 92 covers at least a portion of each of the coaxial cable connectors 82. Each of the latch projections 42 (FIG. 7) is received within the latch opening 40 (FIG. 1) within the corresponding support member 32 or 34 (FIGS. 1 and 2) of the assembly housing 12. As the latch projections 42 are received within the latch openings 40, the deflectable members 98 (FIG. 7) are deflected inwardly toward each other until the hook portions 100 (FIG. 7) clear a shoulder (not shown) of the housing 12. Once the hook portions 100 clear the shoulder, the deflectable members 98 move outwardly away from each other and the hook portions 100 engage the shoulder to latch the cover 36 to the assembly housing 12. In some embodiments, when the cover 36 is latched to the assembly housing 12, the cover 36 may apply a force to the coaxial cable connectors 82 to facilitate holding the coaxial cables 16 on the assembly 10 and in electrical connection with the corresponding coaxial cable connector 14*b*.

When the cover 36 is mounted on the housing 12 of the assembly 10, each of the extensions 103 extends at least partially between two corresponding adjacent coaxial cable connectors 82 and at least partially between two adjacent coaxial cable connectors 14*b* on the mating side portion 24 of the housing 12 of the electrical connector assembly 10. The extensions 103 may facilitate preventing or reducing contact between adjacent coaxial cable connectors 82.

Figure 9:
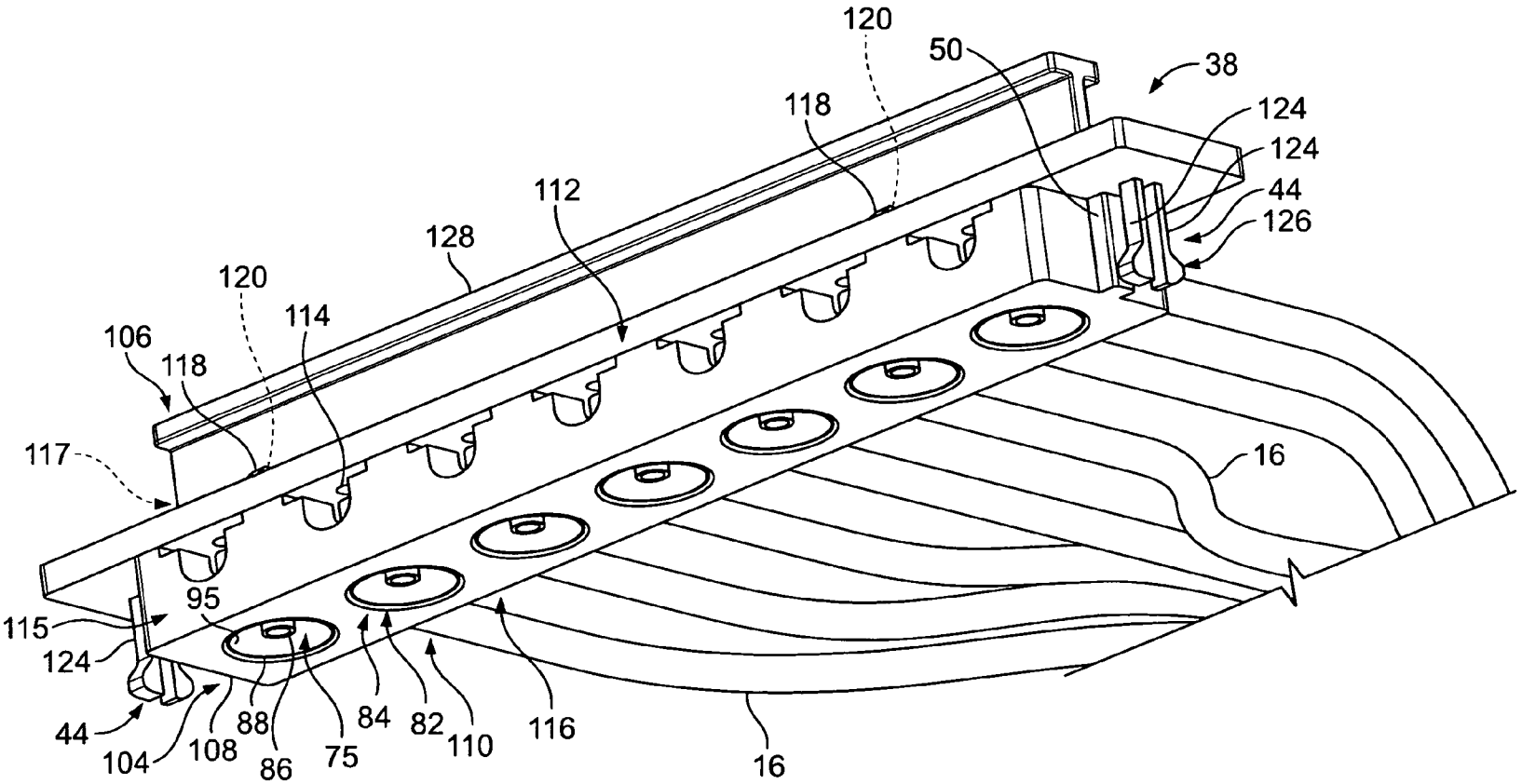
FIG. 9 is a perspective view of an exemplary embodiment of a coaxial cable housing that may be used with the electrical connector assembly embodiments described and/or illustrated herein.

FIG. 9 is a perspective view of an exemplary embodiment of the coaxial cable housing 38. The coaxial cable housing 38 enables a plurality of the coaxial cables 16 to be mated with the electrical connector assembly embodiments described and/or illustrated herein together. In other words, a plurality of the coaxial cables 16 can be mated as a single unit with the electrical connector assembly embodiments described and/or illustrated herein. The coaxial cable housing 38 includes a holder 104 and a cover 106. The holder 104 includes a body 108 that holds the coaxial cable connectors 82 that define the end portions 84 of each of the coaxial cables 16. The holder body 108 includes a mating side portion 110 and an opposite cover side portion 112. The holder body 108 includes a plurality of openings 114 within each of a pair of opposite side portions 115 and 117 of the holder body 108 (only the openings 114 in the side portion 115 are visible in FIG. 9). Each of the openings 114 within one of the side portions (e.g., the side portion 115 in the exemplary embodiment) of the holder body 108 receives a corresponding coaxial cable 16 therein such that each of the cables 16 extends from the corresponding coaxial cable connector 82 outwardly through a portion of the holder 104. The coaxial cable connectors 82 are held by the holder 104 such that the plug portions 77 of the coaxial cable connectors 82 are arranged on the mating side portion 110 of the holder body 108 for each mating with a coaxial cable connector. Each of the coaxial cable connectors 82 may be held by the holder 104 using any suitable structure and/or means that enables the coaxial cable housing 38 to function as described and/or illustrated herein, such as, but not limited to, using an adhesive or a snap-fit connection. In the exemplary embodiment, each of the coaxial cable connectors 82 is held by the holder 104 by a snap-fit connection that permits independent movement of each of the coaxial cable connectors 82 to accommodate misalignment of the coaxial cable connectors 14 and/or differences between the positions of each of the coaxial cable connectors 14.

The holder 104 may optionally include one or more of the alignment projections 50 described above with respect to FIGS. 1 and 2. Each alignment projection 50 cooperates with the alignment opening 46 (FIG. 1) within the corresponding support member 32 and/or 34 (FIGS. 1 and 2) to facilitate aligning the coaxial cable housing 38 with the housing 12 (FIGS. 1, 2, 5, 6, 8, and 10) of the electrical connector assembly 10 (FIGS. 1, 2, 5, 6, 8, and 10) when mating the coaxial cables 16 to the assembly 10. In addition or alternative, the cover 106 may include one or more alignment projections (not shown) for cooperation with the alignment openings 46. Although two alignment projections 50 are shown, the coaxial cable housing 38 may include any number of alignment projections 50 for reception within any number of alignment openings 46. Moreover, although shown as generally rectangular, the alignment projections 50 may have any suitable shape that enables the alignment projections 50 to function as described and/or illustrated herein.

In the exemplary embodiment of FIG. 9, the holder body 108 is elongate and holds the coaxial cable connectors 82 in a single row 116 to match the row 30 (FIGS. 1, 2, and 5) of the coaxial cable connectors 14 (FIGS. 1, 2, and 5). However, the holder body 108 may hold the coaxial cable connectors 82 in any arrangement, pattern, and/or the like that enables the coaxial cables 16 to be electrically connected to the corresponding coaxial cable connectors. Moreover, although seven coaxial cable connectors 82 are shown in FIG. 9, the holder body 108 may hold any number of coaxial cable connectors 82 for electrically connecting any number of coaxial cables 16 to any number of coaxial cable connectors 14. Embodiments of the coaxial cable connectors held by the holder are not limited to the patterns, arrangements, and/or the like described and/or illustrated herein. Rather, embodiments of the coaxial cable connectors may be held by the holder in any suitable pattern, arrangement, and/or the like that enables the coaxial cable housing embodiments to function as described and/or illustrated herein.

The cover 106 is mounted on the cover side portion 112 of the holder body 108 such that the cover 106 covers at least a portion of the coaxial cable connectors 82 of the coaxial cables 16. The cover 106 may be mounted on the holder body 108 using any suitable structure and/or means that enables the coaxial cable housing 38 to function as described and/or illustrated herein, such as, but not limited to, using an adhesive. In the exemplary embodiment, the holder body 108 includes a plurality of latch projections 118 extending outwardly on the cover side portion 112 that cooperate with a plurality of openings 120 within the cover 106 to removably latch the cover 106 to the holder body 108. Although the latch projections 118 may include any suitable structure, means, configuration, arrangement, and/or the like, in the exemplary embodiment the latch projections 118 each include a hook portion 122 (FIG. 10) that engages the cover 106 to latch the cover 106 to the holder 104. The holder body 108 may include any number of latch projections 118. Additionally or alternatively, the cover 106 includes one or more latch projections (not shown) that cooperates with one or more openings (not shown) within the holder body 108.

The cover 106 may optionally include one or more of the latch projections 44 described above with respect to FIGS. 1 and 2. Each latch projection 44 cooperates with the latch opening 40 (FIG. 1) within the corresponding support member 32 and/or 34 to latch the coaxial cable housing 38 to the housing 12 of the electrical connector assembly 10. Although the latch projections 44 may include any suitable structure, means, configuration, arrangement, and/or the like, in the exemplary embodiment the latch projections 44 each include a pair of deflectable members 124. Each of the deflectable members 124 includes a hook portion 126 that engages a shoulder (not shown) of the housing body 18 of the electrical connector assembly 10 to removably latch the coaxial cable housing 38 to the housing body 18. In addition or alternative, the holder 104 may include one or more latch projections for cooperation with the latch openings 40. Although two latch projections 44 are shown, the cover 106 may include any number of latch projections 50 for reception within any number of latch openings 40.

Optionally, the cover 106 may include a handle 128. The handle 128 may have any suitable size, shape, and/or location on the cover 106 that enables the handle 128 to function as described and/or illustrated herein. In the exemplary embodiment, the handle 128 has a T-shaped cross-section and extends outwardly in a direction generally away from the holder 104. The handle 128 provides a structure for a user or machine (not shown) to grasp, and/or apply force to, when mating and unmating the coaxial cable housing 38 to the electrical connector assembly 10. Moreover, the handle 128 may provide a structure for a user or machine to grasp, and/or apply force to, to mount the electrical connector assembly 10 to the circuit board 22 (FIGS. 5, 6, 8, and 10). Specifically, the coaxial cable housing 38 can be mounted on the electrical connector assembly 10 before the assembly 10 is mounted on the circuit board 22. The handle 128 can then be grasped by the user or the machine to place the electrical connector assembly 10 and the coaxial cable housing 38 at the desired location on the circuit board 22.

Figure 10:
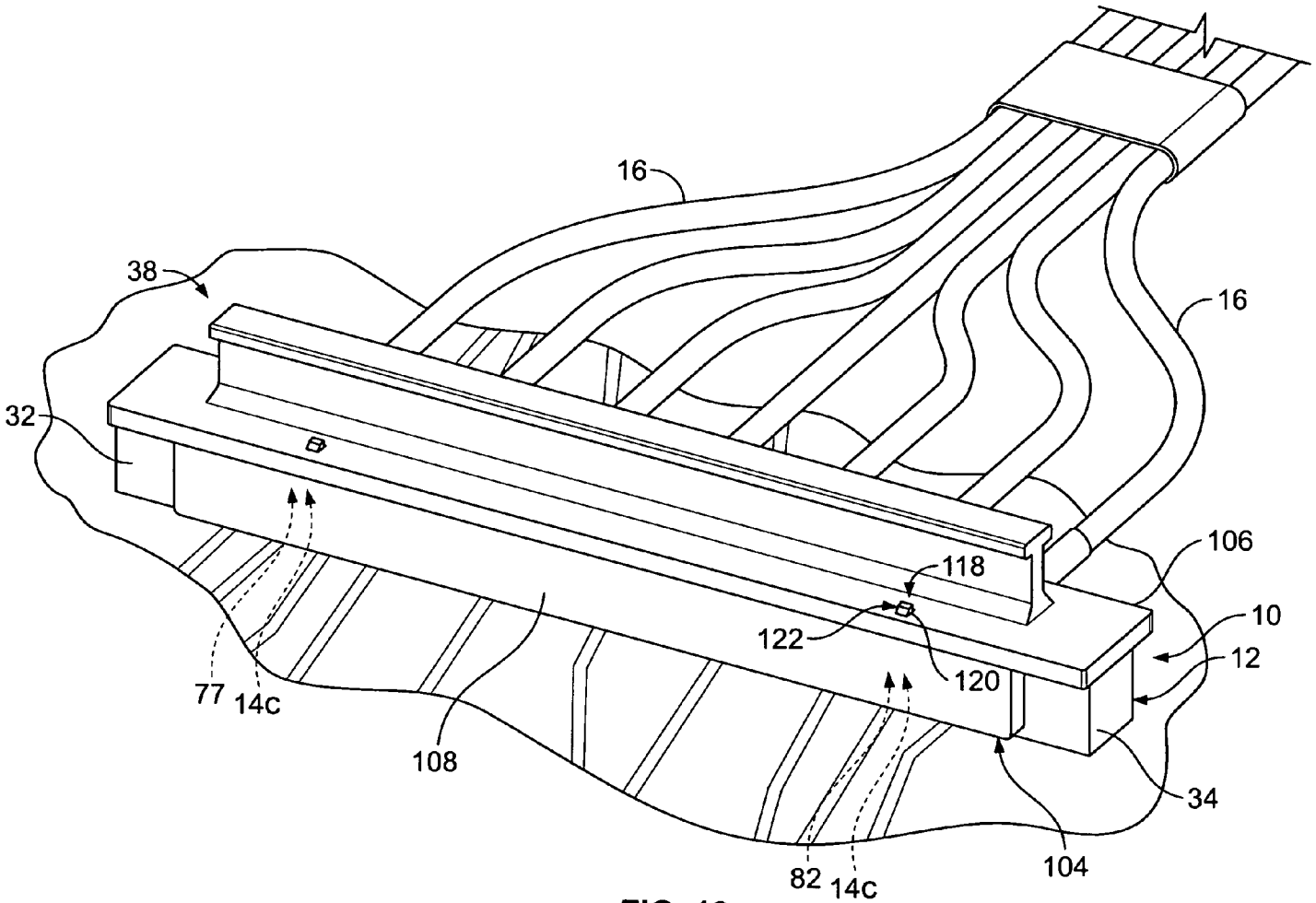
FIG. 10 is a perspective view of an exemplary embodiment illustrating a plurality of coaxial cables are mated with the electrical connector assembly shown in FIGS. 1, 2, and 5 as a single unit using the coaxial cable housing shown in FIG. 9.

FIG. 10 is a perspective view of an exemplary embodiment wherein the coaxial cables 16 are mated with the electrical connector assembly 10 as a single unit using the coaxial cable housing 38. The coaxial cable housing 38 is mounted on the housing 12 of the assembly 10 such that the plug portion 77 (FIGS. 1 and 5) of each of the coaxial cable connectors 14*c* is received within the receptacle 75 (FIG. 9) of the corresponding coaxial cable connector 82 of the coaxial cables 16, and such that the cover 106 covers at least a portion of each of the coaxial cable connectors 82. Each of the latch projections 44 (FIG. 9) is received within the latch opening 40 (FIG. 1) within the corresponding support member 32 or 34 of the assembly housing 12. As the latch projections 44 are received within the latch openings 40, the deflectable members 124 (FIG. 9) are deflected inwardly toward each other until the hook portions 126 clear the shoulder (not shown) of the housing 12. Once the hook portions 126 clear the shoulder, the deflectable members 124 move outwardly away from each other and the hook portions 126 engage the shoulder to latch the coaxial cable housing 38 to the assembly housing 12. The mating end portion 62 (FIGS. 1 and 5) of each of the outer electrical contacts 58 (FIGS. 1, 2, and 5) of the coaxial cable connectors 14*c* is electrically connected to the outer electrical contact 88 (FIG. 9) of the corresponding coaxial cable 16. Similarly, the mating end portion 66 (FIGS. 1 and 5) of each of the inner electrical contacts 60 (FIGS. 1, 2, and 5) of the coaxial cable connectors 14*c* is electrically connected to the inner electrical contact 86 (FIG. 9) of the corresponding coaxial cable 16.

Optionally, in the embodiments of FIGS. 9 and 10, the outer electrical contacts 58 of the connectors 14*c* do not include the groove 89 (FIGS. 1, 5, 6, and 8), and the radially inner surfaces 95 of the coaxial cable connectors 82 do not include the extension 93 (FIGS. 6 and 8) described above with respect to FIGS. 6 and 8. FIG. 3 illustrates a similar embodiment wherein the coaxial cable connectors 314 do not include a groove. Specifically, in some embodiments the outer electrical contacts 58 and the coaxial cable connectors 82 have a slide-on connection, instead of a snap-fit connection, to accommodate misalignment of the coaxial cable connectors 14*c*, differences between the positions of each of the coaxial cable connectors 14*c*, misalignment of the coaxial cable connectors 82, and/or differences between the positions of each of the coaxial cable connectors 82. For example, when mated with the assembly 10, the plug portion 77 of one or more of the coaxial cable connectors 14*c* may not be received as far within the receptacle 75 of the corresponding coaxial connector 82*c* as the plug portion 77 of one or more other coaxial cable connectors 14*c*. In such embodiments wherein a slide-on connection is used, latching of the coaxial cable housing 38 to the assembly 10 via the latch projections 44 may facilitate holding the coaxial cables 16 on the assembly 10 and in electrical connection with the corresponding coaxial cable connector 14*c*. Although the embodiments of FIGS. 1, 3, 5, 6, 8, and 11-13 include a groove (e.g., the groove 89 or the groove 289 shown in FIGS. 11-13) within the outer electrical contacts 58 for cooperation with an extension (e.g., the extension 93 or the extension 293 shown in FIG. 13) of the coaxial cable connectors 82 (or vice versa using a groove on the connector 82 and an extension on the contact 58), and although the embodiments of FIGS. 4, 9, and 10 include a slide-on connection that does not include the grooves and extensions, any of the embodiments described herein may include the grooves and extensions or alternatively may have a slide-on connection that does not include the grooves and extensions.

Figure 11:
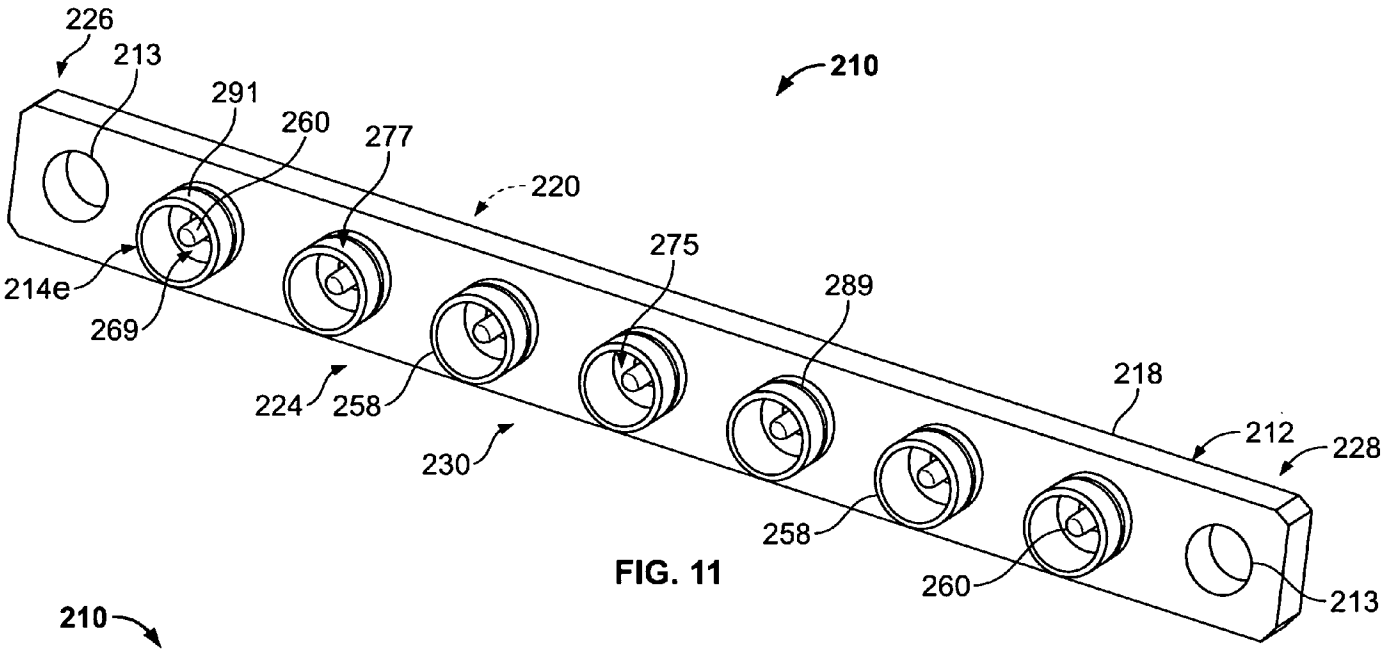
FIG. 11 is a perspective view of an exemplary alternative embodiment of an electrical connector assembly.
Figure 12:
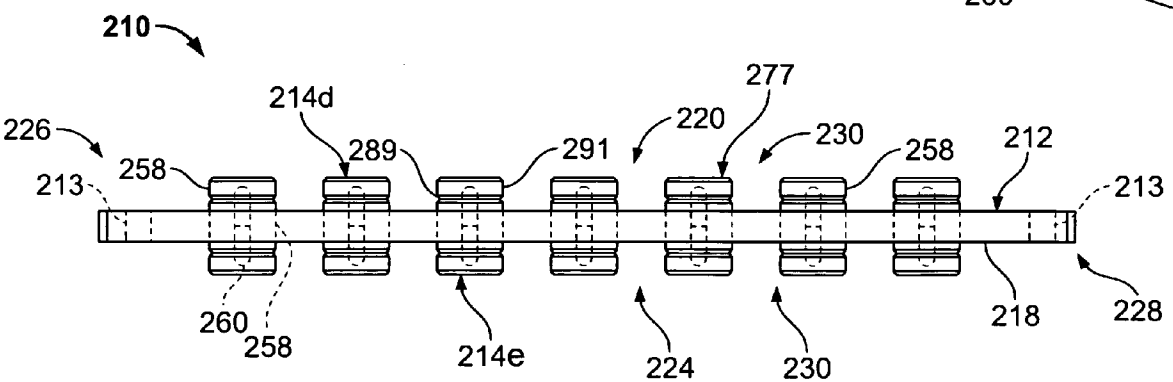
FIG. 12 is a side elevational view of the electrical connector assembly shown in FIG. 11.

FIG. 11 is a perspective view of an exemplary alternative embodiment of an electrical connector assembly 210. FIG. 12 is a side elevational view of the assembly 210. The assembly 210 enables a plurality of the coaxial cables 16 (FIGS. 6, 8-10, and 13) to be interconnected. The assembly 210 includes a housing 212 that holds a plurality of coaxial cable connectors 214*d* and 214*e*. Although not shown herein, the housing 212 may optionally be configured to be mounted, or received, within an opening (not shown) of a panel (not shown). For example, the panel may be a wall of a housing of a device (not shown), such as, but not limited to, a computer. The housing includes a body 218 that may optionally include one or more mounting holes 213 for mounting the housing 212 to the panel. Although two mounting holes 213 are shown, the housing body 218 may include any number of mounting holes 213. The housing body 218 may be dielectric, may be electrically conductive, or a portion of the housing body 218 may be dielectric and another portion may be electrically conductive.

The housing body 218 includes a pair of opposite mating side portions 220 and 224. A portion of each of the coaxial cable connectors 214*d* extends along the mating side portion 220 and a portion of each of the coaxial cable connectors 214*e* extends along the mating side portion 224. The housing body 218 extends between a pair of opposite end portions 226 and 228. In the exemplary embodiment of FIGS. 11 and 12, the housing body 218 is elongate and holds the coaxial cable connectors 214*d* and 214*e* in a single row 230 that extends between the opposite end portions 226 and 228. However, the housing body 18 may hold the coaxial cable connectors 214*d* and 214*e* in any arrangement, pattern, and/or the like that enables the coaxial cables 16 to be electrically interconnected. Moreover, although seven coaxial cable connectors 214*d* and seven coaxial connectors 214*e* are shown in FIG. 12, the housing body 218 may hold any number of coaxial cable connectors 214*d* and 214*e* for electrically interconnecting any number of coaxial cables 16. For example, in other embodiments the housing 212 may have, but is not limited to having, two or more rows of coaxial cable connectors 214*d* and 214*e* and/or staggered connectors 214*d* and 214*e*. Embodiments of the coaxial cable connectors are not limited to the patterns, arrangements, and/or the like described and/or illustrated herein. Rather, embodiments of the coaxial cable connectors may be held by the housing in any suitable pattern, arrangement, and/or the like that enables the electrical connector assembly embodiments to function as described and/or illustrated herein.

Each of the coaxial cable connectors 214*d* and 214*e* includes an outer electrical contact 258 and an inner electrical contact 260 extending generally coaxially with each other. The outer electrical contact of 258 of each coaxial cable connector 214*d* is electrically connected to the outer electrical contact 258 of a corresponding one of the coaxial cable connectors 214*e*. Similarly, the inner electrical contact of 260 of each coaxial cable connector 214*d* is electrically connected to the inner electrical contact 260 of a corresponding one of the coaxial cable connectors 214*e*. In the exemplary embodiment, the outer electrical contacts 258 of each corresponding pair of connectors 214*d* and 214*e* are formed as one integral structure that extends from the mating side portion 220 through the housing body 218 to the mating side portion 224. Similarly, the inner electrical contacts 260 of each corresponding pair of connectors 214*d* and 214*e* are formed as one integral structure that extends from the mating side portion 220 through the housing body 218 to the mating side portion 224. Accordingly, in the exemplary embodiment each pair of corresponding coaxial cable connectors 214*d* and 214*e* is formed as one integral structure that extends through the housing body 218. Alternatively, the outer electrical contacts 258 and/or the inner electrical contacts 260 of one or more corresponding pairs of connectors 214*d* and 214*e* are formed as two structures that are electrically connected together, whether directly or using an intermediate electrical contact (not shown). In the exemplary embodiment, each pair of corresponding coaxial cable connectors 214*d* and 214*e* is coaxially aligned. Alternatively, one or more of the corresponding pairs of coaxial cable connectors 214*d* and 214*e* are not coaxially aligned.

In the exemplary embodiment, the housing body 218 is dielectric and for each coaxial cable connector 214*d* and 214*e*, a corresponding portion 269 of the housing body 218 separates the outer and inner electrical contacts 258 and 260, respectively, from one another to electrically isolate the outer and inner electrical contacts 258 and 260, respectively, from one another. Alternatively, whether or not the housing body 218 is at least partially dielectric, one or more dielectric members (not shown) that is separate from the housing body 218 (but which may be attached to the housing body 218) may separate the outer and inner electrical contacts 258 and 260, respectively, from one another to electrically isolate the outer and inner electrical contacts 58 and 60, respectively, from one another. If included, the dielectric member(s) that is separate from the housing body 218 may be fabricated from the same and/or different materials of any dielectric portions that the housing body 218 may include.

As will be described in more detail below, the outer and inner electrical contact 258 and 260, respectively, of each connector 214*d* and 214*e* is configured to be electrically connected to the outer and inner electrical contact 88 and 86 (FIG. 9), respectively, of a corresponding one of the coaxial cables 16.

In the exemplary embodiment, a radial gap between the outer and inner electrical contacts 88 and 86, respectively, of each of the coaxial cables 16 defines a receptacle 75 (FIG. 9) that is configured to receive a plug portion 277 of the corresponding coaxial cable connector 214*d* and 214*e* therein, as will be described in more detail below. Alternatively, one or more of the coaxial cable connectors 214*d* and/or 214*e* may define a receptacle (not shown) for receiving a plug portion (not shown) of the corresponding coaxial cable 16. In the exemplary embodiment, the outer electrical contacts 258 are ground contacts and the inner electrical contacts 260 are signal contacts. However, one or more of the outer electrical contacts 258 may alternatively be a signal contact and/or one or more of the inner electrical contacts 260 may alternatively be a ground contact. Although shown as having a generally circular cross-sectional shape, the coaxial cable connectors 214*d* and 214*e* may alternatively have any other suitable cross-sectional shape that enables the connectors 214*d* and 214*e* to function as described and/or illustrated herein, such as, but not limited to, a rectangular cross-sectional shape.

Although the housing body 218 is described herein in the exemplary embodiment as being dielectric, the housing body 218 may additionally or alternatively be fabricated from at least partially from an electrically conductive material such that the housing body 218 forms a common ground for each of the coaxial cable connectors 214*d* and 214*e* that are held thereby. In such an embodiment, the portions 269 of the housing body 18 may remain dielectric to electrically isolate the inner electrical contacts 260 from the outer electrical contacts 258 and the common ground formed by the housing body 218, or as described above a dielectric member (not shown) that is separate from the housing body 218 (but which may be attached to the housing body 218), may electrically isolate the outer and inner electrical contacts 258 and 260, respectively, from one another.

Figure 13:
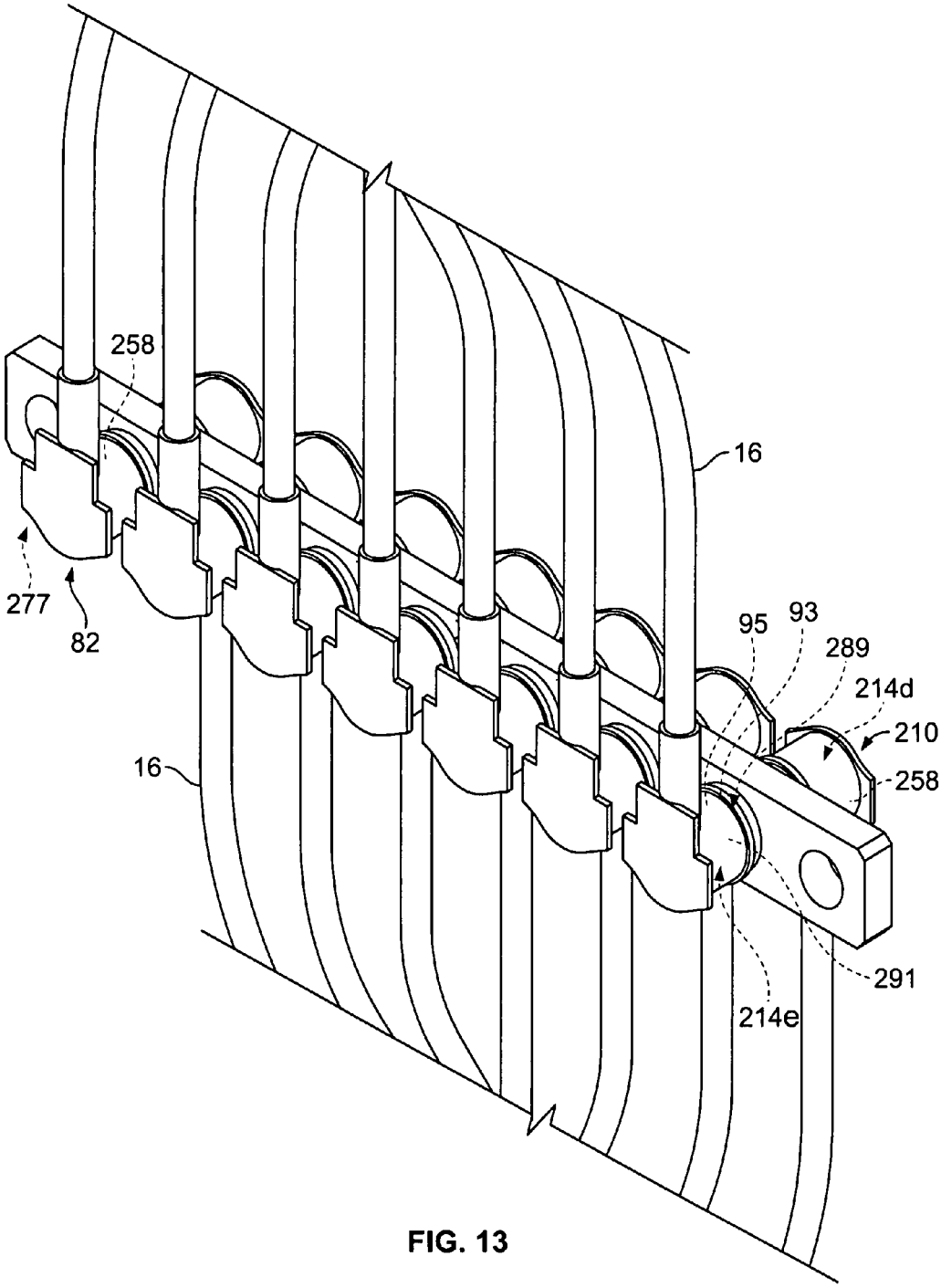
FIG. 13 is a perspective view of an exemplary embodiment illustrating the interconnection of a plurality of coaxial cables using the electrical connector assembly shown in FIGS. 11 and 12.

FIG. 13 is a perspective view of an exemplary embodiment wherein the coaxial cables 16 are interconnected using the electrical connector assembly 210. The assembly 210 enables each of the coaxial cables 16 to be electrically interconnected with a corresponding other one of the cables 16. Specifically, the plug portion 77 of each coaxial cable connector 214*d* and 214*e* is received within the receptacle 75 (FIG. 9) of the corresponding coaxial cable connector 82. The inner electrical contact 86 (FIG. 9) of each coaxial cable connector 82 is electrically connected to the inner electrical contact 260 (FIGS. 11 and 12) of the corresponding coaxial cable connector 214*d* or 214*e*. Similarly, the outer electrical contact 88 (FIG. 9) of each coaxial cable connector 82 is electrically connected to the outer electrical contact 258 of the corresponding coaxial cable connector 214*d* or 214*e*. Each pair of corresponding coaxial connectors 214*d* and 214*e* thereby electrically interconnects the outer and inner electrical contacts 88 and 86, respectively, of a corresponding pair of the coaxial cables 16.

In the exemplary embodiment of FIGS. 11-13, each of the outer electrical contacts 258 of the connectors 214*d* and 214*e* includes a groove 289 extending within a radially outer surface 291 of the outer electrical contact 258 that cooperates with an extension 93 on a radially inner surface 95 of the outer electrical contact 88 of the corresponding coaxial cable connector 82. Cooperation between the groove 289 and the extension 93 creates a snap-fit connection that may facilitate holding the coaxial cables 16 on the assembly 210 and in electrical connection with the corresponding coaxial cable connector 214*d* or 214*e*. Additionally or alternatively, one or more of the outer electrical contacts 258 of the connectors 214*d* and/or 214*e* includes an extension (not shown) that cooperates with a groove (not shown) on the radially inner surface 95 of the outer electrical contact 88 of the corresponding coaxial cable connector 82.

The embodiments described and/or illustrated herein provide a coaxial cable connector that may be more easily installed on a circuit board or other portion of an electronic device than at least some known coaxial cable connectors. The embodiments described and/or illustrated herein provide a coaxial cable connector that may be more easily mated and unmated with a coaxial cable than at least some known coaxial cable connectors.

Although the coaxial cables 16 are shown herein as having right angle connectors 82 that generally extend perpendicular to a longitudinal axis 130 (FIG. 6) of the cables 16, one or more of the coaxial cables 16 may alternatively include a coaxial cable connector that is not generally disposed perpendicular to the axis 130 (e.g., a coaxial cable connector that extends generally parallel with the longitudinal axis 130).

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. For example, although specific sensor elements are described and/or illustrated with specific attachment devices, each described and/or illustrated sensor element may be used with any of the described and/or illustrated attachment devices as is appropriate. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

While the invention has been described in terms of various specific embodiments, those skilled in the art will recognize that the invention can be practiced with modification within the spirit and scope of the claims.

What is claimed is:

1. An electrical connector assembly for electrically connecting a plurality of coaxial cables to a circuit board, said assembly comprising:

an at least partially dielectric housing having a mounting side portion configured to be mounted to the circuit board and a mating side portion opposite the mounting side portion; and a plurality of coaxial cable connectors held by the housing, each coaxial cable connector comprising an outer electrical contact and an inner electrical contact extending generally coaxially with each other, each outer and inner electrical contact extending from a mating end portion on the mating side portion of the housing to a mounting end portion, the mounting end portion of each of the outer and inner electrical contacts being configured to be electrically connected to a corresponding electrical contact on the circuit board, the mating end portion of each of the outer and inner electrical contacts being configured to be electrically connected to an electrical contact of a corresponding one of the coaxial cables, wherein the coaxial cable connectors are arranged in a row, the housing comprising a plurality of openings extending through the housing, each opening extending between a corresponding pair of adjacent coaxial cable connectors within the row, each opening exposing at least a portion of the mounting end portion of the inner electrical contact of at least one of the corresponding pair of adjacent coaxial cable connectors.

2. The electrical connector assembly according to claim 1, wherein the housing comprises an opening extending through the housing, the opening extending adjacent at least one of the coaxial cable connectors and exposing at least a portion of the mounting end portion of the inner electrical contact of the adjacent coaxial cable connector.

3. The electrical connector assembly according to claim 1, wherein the plurality of coaxial cable connectors each comprise a plug portion configured to be received within a receptacle of the coaxial cables.

4. The electrical connector assembly according to claim 1, wherein the circuit board includes a surface having an electrical contact thereon, the housing being configured to be mounted on the circuit board such that the plurality of coaxial cable connectors extend outwardly from the surface of the circuit board in a nonparallel direction relative to the surface.

5. The electrical connector assembly according to claim 1, further comprising a cover configured to be mounted on the housing at the mating side thereof.

6. The electrical connector assembly according to claim 5, wherein the cover comprises a body having at least one extension extending outwardly therefrom, the extension configured to extend at least partially between two adjacent coaxial cable connectors when the cover is mounted on the housing.

7. The electrical connector assembly according to claim 5, wherein the cover comprises a body having a handle extending outwardly therefrom.

8. The electrical connector assembly according to claim 5, wherein the housing comprises at least one latch opening and the cover comprises a body having a latch projection extending outwardly therefrom, the latch projection being configured to cooperate with the latch opening to latch the cover to the housing.

9. The electrical connector assembly according to claim 5, wherein the housing comprises an alignment opening and the cover comprises a body having an alignment projection, the alignment projection being configured to be received within the alignment opening to align the cover with the housing.

10. The electrical connector assembly according to claim 1, further comprising the coaxial cables coupled to the housing such that each coaxial cable is electrically connected to a corresponding one of the coaxial cable connectors.

11. The electrical connector assembly according to claim 1, further comprising the circuit board, wherein the housing is mounted on the circuit board such that the mounting end portion of each of the outer and inner electrical contacts is electrically connected to the corresponding electrical contact on the circuit board.

12. The electrical connector assembly according to claim 11, wherein the housing comprises an opening therein, the opening extending adjacent at least one of the plurality of coaxial cable connectors and exposing at least a portion of an interface between the mounting end portion of the outer or inner electrical contact of the adjacent coaxial cable connector and the corresponding electrical contact on the circuit board.

13. The electrical connector assembly according to claim 1, wherein the housing openings, each outer electrical contact of the plurality of coaxial cable connectors being held by the housing within a corresponding one of the openings.

14. An electrical connector assembly for electrically connecting a plurality of coaxial cables to a circuit board, said assembly comprising:

an at least partially dielectric connector housing having a mounting side portion configured to be mounted to the circuit board and a mating side portion opposite the mounting side portion;

a plurality of first coaxial cable connectors held by the connector housing, each first coaxial cable connector comprising a first outer electrical contact and a first inner electrical contact extending generally coaxially with each other, each first outer and inner electrical contact extending from a mating end portion on the mating side portion of the connector housing to a mounting end portion, the mounting end portion of each of the first outer and inner electrical contacts being configured to be electrically connected to at least one corresponding electrical contact on the circuit board;

a coaxial cable housing having opposite first and second side portions; and a plurality of second coaxial cable connectors held by the coaxial cable housing, each of the second coaxial cable connectors defining an end portion of a corresponding one of the coaxial cables and comprising a second outer electrical contact and a second inner electrical contact extending generally coaxially with each other, wherein the mating end portion of each of the first outer electrical contacts is configured to electrically connect to the second outer electrical contact of a corresponding one of the coaxial cables, and wherein the mating end portion of each of the first inner electrical contacts is configured to electrically connect to the second inner electrical contact of a corresponding one of the coaxial cables, wherein the coaxial cable connectors are arranged in a row, the connector housing comprising a plurality of openings extending through the connector housing, each opening extending between a corresponding pair of adjacent first coaxial cable connectors within the row, each opening exposing at least a portion of the mounting end portion of the first inner electrical contact of at least one of the corresponding pair of adjacent first coaxial cable connectors.

15. The electrical connector assembly according to claim 14, wherein the coaxial cable housing comprises a holder and a cover, the holder holds the second coaxial cable connectors, and the cover covers at least a portion of the second coaxial cable connectors.

16. The electrical connector assembly according to claim 14, wherein the connector housing comprises at least one latch opening and the coaxial cable housing comprises a body having a latch projection extending outwardly therefrom, the latch projection being configured to cooperate with the latch opening to latch the coaxial cable housing to the connector housing.

17. The electrical connector assembly according to claim 14, further comprising the plurality of coaxial cables, the plurality of coaxial cables comprising a plurality of first coaxial cables and a plurality of second coaxial cables, each of the first coaxial cables being engaged with a corresponding one of the first coaxial cable connectors, each of the second coaxial cables being engaged with a corresponding one of the second coaxial cable connectors.

* * * * *